US006695611B2

(12) United States Patent
Lee

(10) Patent No.: US 6,695,611 B2
(45) Date of Patent: Feb. 24, 2004

(54) SAFETY CANDLE

(76) Inventor: Wooil W. Lee, 49 Coulter St. Apt. 1206, Barrie, On. (CA), L4M 3C1

( * ) Notice: Subject to any disclaimer, the term of this patent is extended or adjusted under 35 U.S.C. 154(b) by 140 days.

(21) Appl. No.: 09/955,040

(22) Filed: Sep. 19, 2001

(65) Prior Publication Data

US 2003/0054312 A1 Mar. 20, 2003

(51) Int. Cl.[7] ..... F23D 3/16
(52) U.S. Cl. ..... 431/293; 431/292
(58) Field of Search ..... 431/293, 292, 431/294, 289, 206

(56) References Cited

U.S. PATENT DOCUMENTS 3,121,316 A * 2/1964 Wilson et al. ..... 431/206
4,013,397 A * 3/1977 Neugart ..... 431/291
6,428,311 B1 * 8/2002 Bernardo ..... 431/293

* cited by examiner

*Primary Examiner*—Alfred Basichas
(74) *Attorney, Agent, or Firm*—Douglas W. Eggins

(57) ABSTRACT

Candles without conventional wicks have a long-life wick assembly mounted upon them, consisting of a supporting metallic dish that carries a permanent short wick. The wick includes heat conducting elements, which convey heat downwardly from the candle flame to form a pool of molten wax below the dish, into which pool the wick extends. Wick extensions may be used, when a permanent container supports the wick assembly. In the case of free-standing wax candles the shape and construction of the wick-support dish limits the extent of the pool, to maintain the surrounding candle wall intact. The candles are long-burning, and the wick assembly follows down the length of the candle, as the candle is consumed. The metallic dish acts as a heat and safety barrier, to contain the candle flame. An intermediate yoke supports the wick and connects the wick to the dish and limits the rate of heat transfer to the underlying candle. A removable flame damper may be applied about the upper wick portion, to limit the size of the flame.

18 Claims, 6 Drawing Sheets

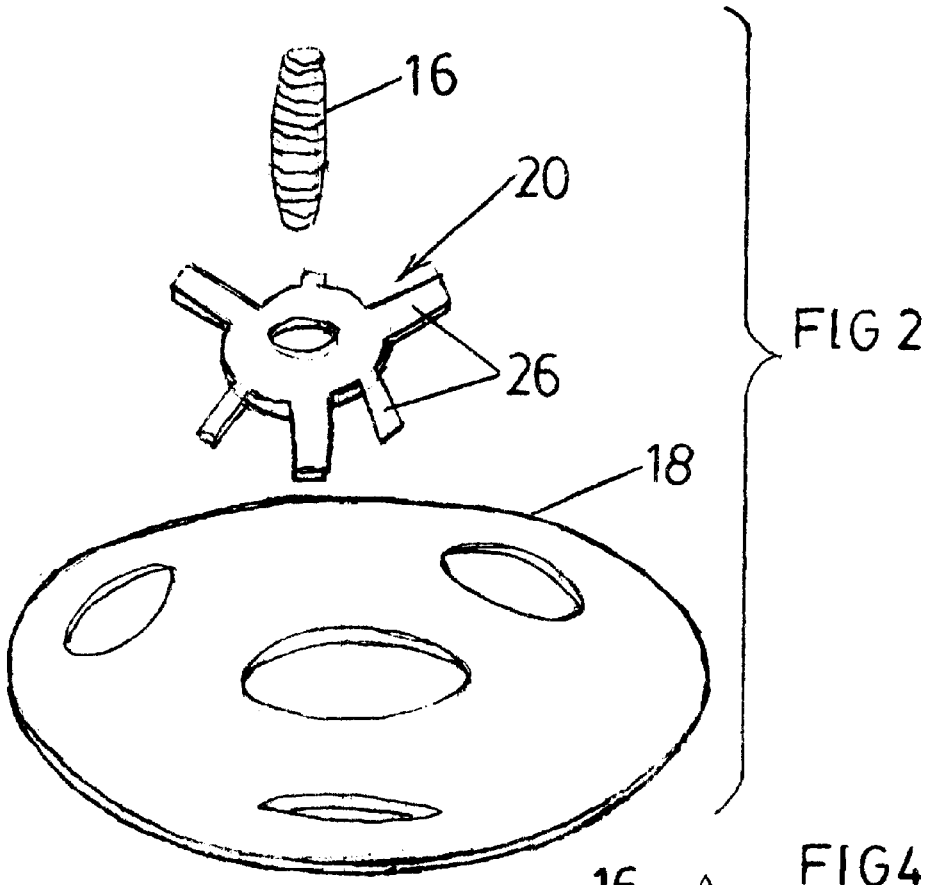
FIG3
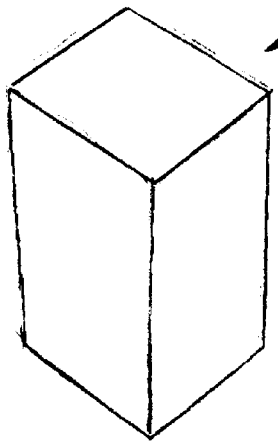
FIG4
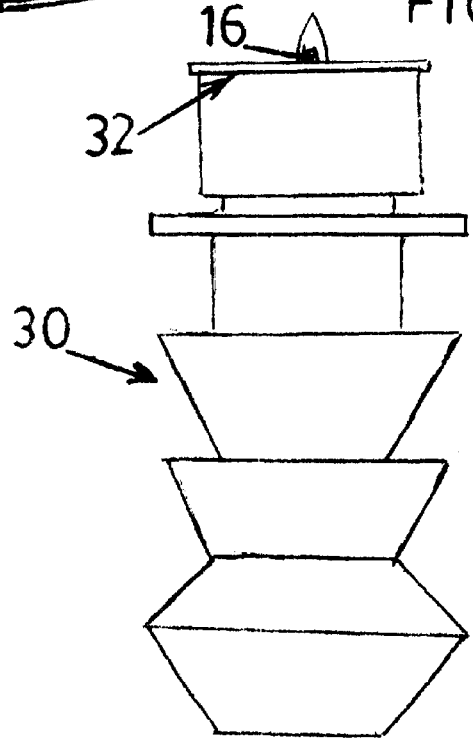

78
70
60
76
62
72
64
74
66
68

80
13
13
78

84
70

82

SAFETY CANDLE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. This invention is directed to a safety candle, and in particular to a candle incorporating a mobile, wick system, having a permanent wick mounted in a shallow container.

2. Historically, the use of candles for many purposes extends back into the mists of antiquity. Wax and tallow candles have been widely used as sources of light and heat, as well as for decorative purposes and in churches as votive symbols, and in modern times for purposes of generating scents, as table decoration in homes and restaurants, and as a de-odoriser.

The candle forms the historical basis for measuring light intensity, by way of "candlepower" ratings.

The candles of the prior art incorporate a central wick that extends the full length of the candle, extending from the top end thereof, and which, in the traditional manner of candle making serves as the basis for candle dipping, wherein the wick is repeatedly dipped in wax, to build up a desired thickness of candle, centered on the wick.

One drawback of prior art candles is the manner in which hot wax from the burning candle may overflow down the sides of the candle to cause a mess, with a propensity for initiating or spreading a fire when the candle burns down. The propensity to drip is fostered, in the case of many candles, by the provision of an upwardly tapered end, terminating at the projecting wick.

In use, when lighted the continuous wick of a candle serves as the base for the candle flame, and as the wax burns or drips away, the exposed outer end of the wick itself chars and combusts and ultimately tends to fall away.

Owing to the danger presented by an open candle flame, it is customary to use some form of candle-holder, to minimize the danger of initiating a conflagration, particularly when the candle nears the end of its "life".

BRIEF SUMMARY OF THE INVENTION

The present invention provides a candle having a mobile wick system assembly incorporating a permanent wick of limited height and a wick suspension including a thermal barrier, wherein the body of the candle is wickless, being surmounted by the wick assembly.

The top of a plain or wickless candle is hollowed out to accommodate a wick assembly in accordance with the present invention in seated relation therein.

In use, upon igniting the wick a limited transfer of heat takes place downwardly, by way of the wick and the thermal barrier, both of which conduct heat from the burning candle downwardly, thus forming a stable pool of melted wax of limited dimension, located primarily below the barrier, which the wick draws upon to maintain itself alight.

As the burning of the candle progresses over time, the wick assembly moves downwardly in stable fashion, forming a substantially constant reservoir of melted wax in the vicinity of the wick, while maintaining the outer wall portion of the candle in a firm condition.

The wick assembly consists of the wick, per se, together with its suspension means.

One embodiment of the wick suspension means consists of a metallic, perforated dish consisting of an inverted truncated cone, a central aperture of which accommodates the wick, and having one or more perforations in the conical surface of the dish to facilitate stable downward passage of the wick assembly, relative to the body of the candle, as the candle bums.

The dish usually has a diameter greater than the diameter of the candle body with which it is used. The wick assembly is of balanced construction, to maintain a level posture as the wax softens, to permit progressive downward passage of the wick as the candle burns The wick per se is preferably of limited length, usually in the order of about two centimeters, being a substantially rigid permeable structure incorporating one or more metallic elements for purposes of integrating the wick structure, and for conducting heat downwardly away from the candle flame, while facilitating the upward "wicking" of molten wax to the flame zone.

In the case of cup-candles, as disclosed below, one or more cotton extension wicks may depend from the short, upper flame-supporting wick, the extensions serving to wick-up wax to the upper flame-supporting wick portion, while remaining isolated from the candle flame combustion zone. In a preferred hand-made wick embodiment the wick consists of a carbonized bundled mixture of fibres, with a metal binding, including fine wire.

In one embodiment, for a long-life candle of about two inches diameter the wick fibre bundle has a final diameter of about six millimeters (i.e. about ¼ inch).

One formulation for hand-made wicks consists of a mixture of cotton, nylon and polyester threads, bound together with a fine wire, such as a strand of fine copper wire similar to that from a flexible electric cord, or with a fine string. A central core of wire may serve as a .spine.

The wick support means preferably includes an intermediate yoke, bridging between the dish and the wick, to support the lower end of the wick in extending relation below the bottom of the dish, such that in use, when the candle is alight, the wick projects downwardly into a pool of molten wax located substantially on the main axis of the candle. Particulars of manufacture follow below.

A yoke characteristically has a number of outwardly extending supporting arm portions that secure it to the adjacent, surrounding dish, while serving to regulate the rate of heat transfer from the wick to the dish, and thence to the underlying candle body.

The portion of the wick above the yoke carries the flame, without itself being consumed, while the portion beneath the yoke and dish is submerged in or connected in wicking relation with the pool of melted wax, and is not exposed to the flame, serving to wick-up the molten wax into the upper, combustion zone of the candle flame.

The provision of metal elements in the structure of the wick provides structural stiffness, together with heat transfer capability, to transfer heat from the candle flame to the underlying wax pool. Manufacture of different embodiments of the wick is detailed below.

Candles in accordance with the invention burn economically and in very stable fashion.

In situations where assemblies of candles are used, the consistency of their burning rates enables such candles to burn in relative symmetry, at substantially equal rates.

The use of a superimposed wick permits the production of extremely low cost wickless candle bodies, which may be cast in molds or extruded. Candles having an unusually long burning life may be readily made.

The adoption of a wickless candle body facilitates an almost unlimited variety of candle shapes, generally based upon a central cylindrical body with a cross-section approximating the plan view of the wick dish. It will be understood that the wick dish and cylindrical candle body may have a plan shape other than circular.

One form of candle body dispenses with the need for a candle holder, a base portion of the candle being significantly larger transversely than the upper, combusting portion of the candle.

The enlarged base portion provides stability to the candle, and is not consumed when the candle burns right to the bottom, with the candle dish having consumed the central portion of the base, while leaving a protective anulus of wax surrounding the wick assembly tray.

The wick support dish can be economically manufactured from the top and bottom portions of recycled pop, beer and miscellaneous other pop cans, preferably of aluminum or other light alloy.

The residual wall of the can may be used in the manufacture of a yoke portion for the wick suspension, also for decorative overlays, such as animal symbols through which the candle flame emerges, as well as superficial decoration portions suspended from the wick dish, or commercial promotional "banners", which may include the original labelling of the can product.

An optional decorative overlay may be removably mounted upon the yoke portion of the wick mounting. The overlay, which may have the wick passing upwardly therethrough, may be in the form of a flower, an animal or other desired symbol or decoration.

The selection of wicks of different lengths affects the burning characteristics of the candle, both in the form of the flame and in the depth of the pool of molten wax formed beneath the wick dish.

One embodiment of the present invention, referred to as the wick-cup, involves the use of a container such as a glass, stein, tankard or cup as the candle holder.

A quantity of liquid, such as water or beer may fill a lower portion of the container/stand, within which molten wax from the candle may be deposited, to solidify into various entertaining and intriguing shapes.

The incorporation of the subject candle with a drinking glass, tankard or stein bearing the trademark of a particular company provides a noteworthy promotional item for that company. The wick assembly of a cup-candle is supported by the cup, glass or tankard, usually resting upon the rim of the container.

In such an arrangement, the loss of wax due to burning of the lighted candle can be readily replenished by removing the wick assembly and depositing wax particles, shavings etc into the crater of the candle. This operation can be readily effected without extinguishing the candle. The external appearance of the lighted wick-cup candle does not change, as the wick assembly with its supporting dish sits upon the rim of the container.

The flame (burning) life for a wick-cup candle with a 3.5 inch cup of wax particles, shavings etc is about two hours, such that replenishment with wax particles and shavings is required, to maintain it alight.

The replenishment of consumed wax can also be readily effected by depositing an anulus of wax upon the upper surface of the dish, where it melts down into the underlying wax pool located beneath the wick tray. Downward passage of the wax from the anulus, as it melts from the radiated heat of the candle is facilitated by the apertures associated with both the yoke and with the tray per se.

The lower structure of the wick is preferably modified by the addition of trailing cotton wicks, to promote the transfer of melted wax to the burning zone, as the level of the melted pool of wax recedes downwardly, away from the stationary dish of the wick assembly. These wick extensions are not in the zone of the flame, and are not consumed, as would be the case in the prior art.

A bowl-candle embodiment, which may utilize a glass bowl, usually requires extension wick strings, in order to reach the pool of wax formed within the wax content of the bowl. A perforated metal skirt that encircles the wick assembly facilitates the insertion of the wick assembly into the wax content of the bowl, and serves to protect the individual limp wick extension portions.

The wax in the bowl is hollowed out to permit the insertion of the skirted wick assembly. The wax may comprise layers of decorative colours, particles, shavings, or cast layers.

The perforated metal skirt, usually of aluminum, helps transfer heat downwardly from the candle flame zone to the unmelted wax, and the perforations permit the passage of melted wax into the molten wax pool, from which the string wick extensions wick-up wax to the wick flame zone.

A further refinement is the addition of a removable damper plate, by which the flame can be controlled, to limit the candle burning rate.

Another embodiment may be mounted within a china or earthenware vessel of beaker-like form, and having a removable lid, through which a wick assembly protrudes. The wick assembly may include wick extension portions and a protective skirt, as with the bowl-candle.

The subject candles are well suited for use in restaurants to take up odors, and as decoration.

The stability and consistency of the size of the candle flame, with a substantially unvarying rate of combustion afforded by the subject wick leads to the possibility of giant candles having an array of a multiplicity of such wicks arranged on its surface, for simultaneous burning. The array of wicks may be formed into various designs on top of the candle.

Owing to the use of a permanent wick, the lighting of such candles requires more time than that required to light prior art candles, due to the greater mass of wick being ignited. However, the subject candles are more stable than prior art candles, being less vulnerable to accidental extinction from drafts.

It will be understood that the subject permanent wick has a long life, and can be used with a succession of candles.

The bowl-candle and beaker-candle may replace oil lamps, being much less hazardous, if dropped.

In the case of the bowl-lamp, the adoption of a threaded neck to the bowl permits a wick in accordance with the invention to be adjustably mounted therein, such that the location of the wick, with reference to the level of wax within the bowl may be selectively varied. This threaded embodiment then enables ready determination of the approximate burn time for the candle, by selective adjustment of the elevation of the wick by rotation of the wick holder on its threads.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

FIG. 2 is an exploded view in perspective of the elements of a second embodiment of a permanent wick assembly;

FIG. 3 is a perspective side view of a wickless candle body of rectangular section;

FIG. 4 is a side view of an ornamental wickless candle

DETAILED DESCRIPTION OF THE INVENTION

Figure 1:
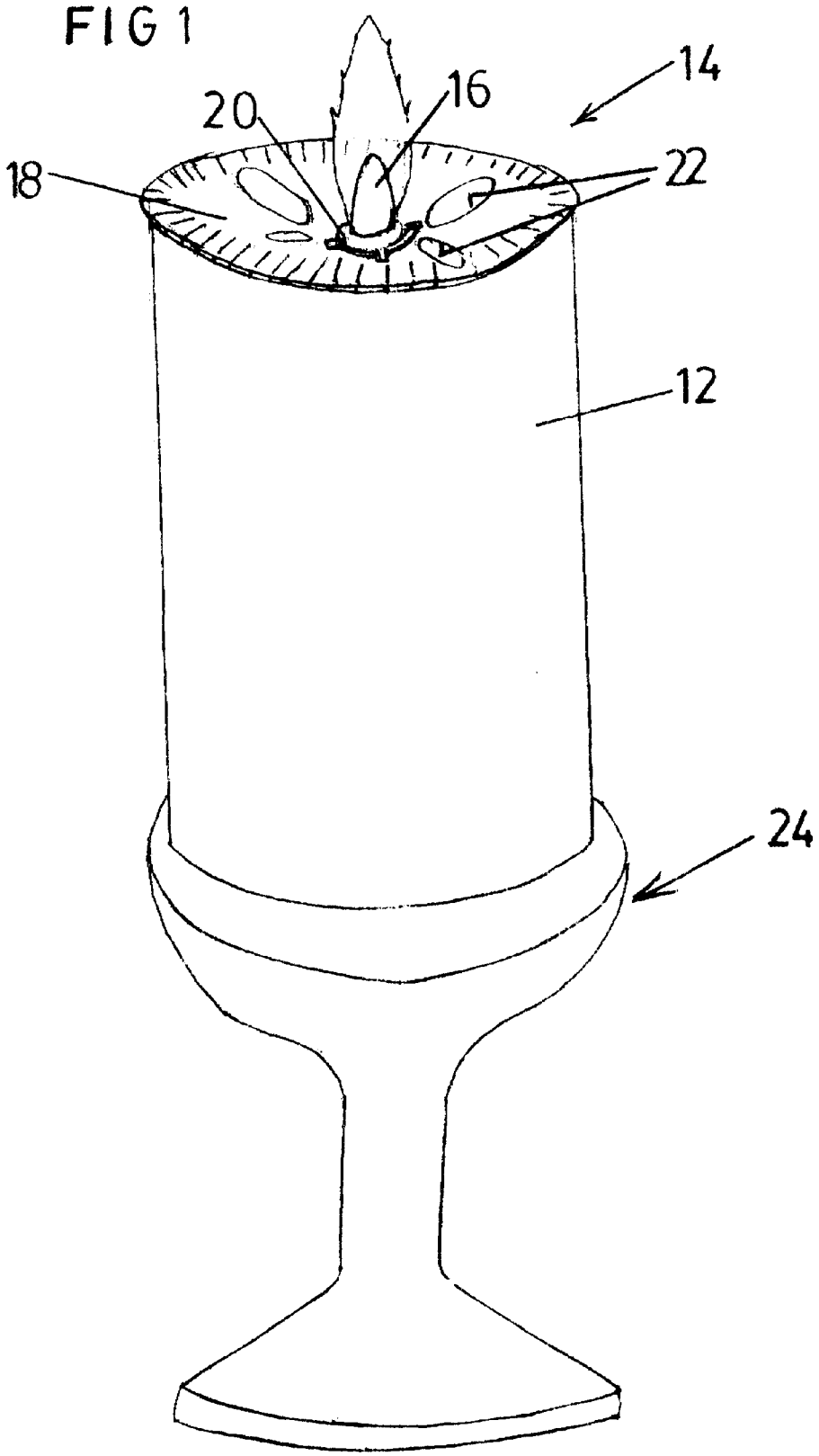
FIG. 1 is a frontal perspective view, in elevation, of a wickless candle having a first embodiment according to the present invention of a permanent wick assembly mounted thereon.

Referring to the drawings, in FIG. 1, a candle 10 in accordance with the present invention consists of a wickless wax cylinder 12 surmounted by a wick assembly 14.

The wick assembly 14 consists of a compound wick 16 mounted in a conical dish 18 by means of a suspension yoke 20. The rim portion of the dish 18 is segmented, and through apertures 22 perforate the dish 18. The candle 10 is illustrated as mounted in a glass dish 24, which does not form a part of the invention.

Turning to FIG. 2, the yoke 20 is shown as having six radially extending arm portions 26, three of which are deformed upwardly, in use to engage the top surface of the dish 18, and three of which are deformed downwardly, to engage the reverse face of the dish 18.

FIG. 3 shows a wickless wax cylinder 28 of right rectangular form. It will be understood that a wick assembly for this form of candle 28 would preferably be of corresponding rectangular plan profile.

FIG. 4 shows a side elevation of a wickless fancy candle body 30, of complex profile having a wick assembly 32 mounted thereon.

Figure 5:
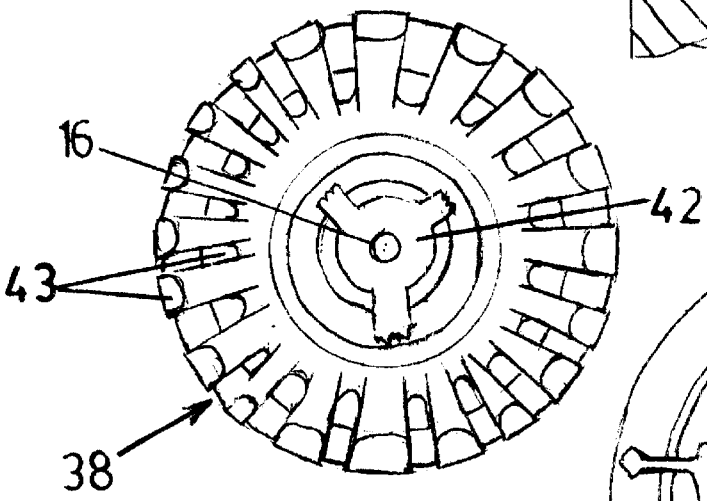
FIG. 5 is a plan view of a decorative wick assembly.
Figure 6:
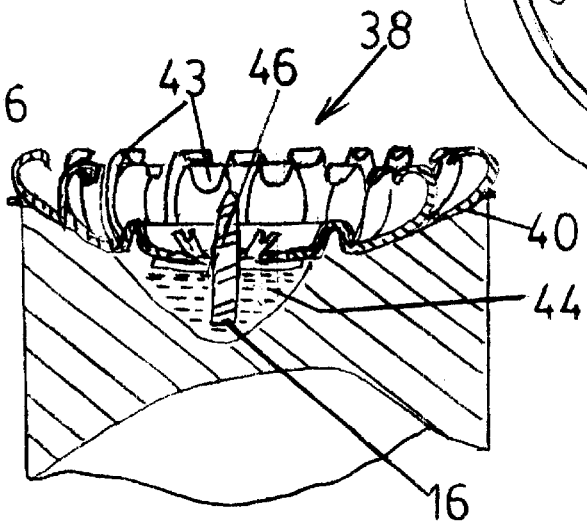
FIG. 6 is a diametrical section of the FIG. 5 embodiment.

Referring to FIGS. 5 and 6, a wickless candle body 36, of which only the top portion is illustrated, has a fanciful wick assembly 38 mounted thereon. The dish portion 40 of the assembly 38 has a series of upstanding petals 43 in an inner and an outer annular array.

A wick 16 is carried by a yoke 42 which secures the wick 16 in predetermined spaced relation from the dish portion 40.

As will be seen in FIG. 6, the wick 16 creates a pool of molten wax 44 in the near vicinity, the heat transfer being facilitated by heat conductive metal element portions 46, shown as being helically wound about the wick 16.

Figure 7:
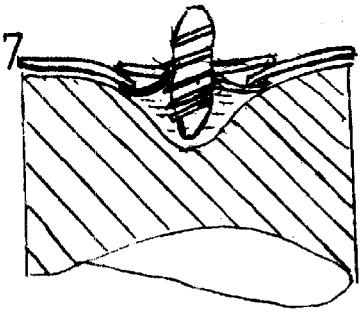
FIG. 7 is a diametrical section of the FIG. 2 wick in assembled relation with a candle.
Figure 8:
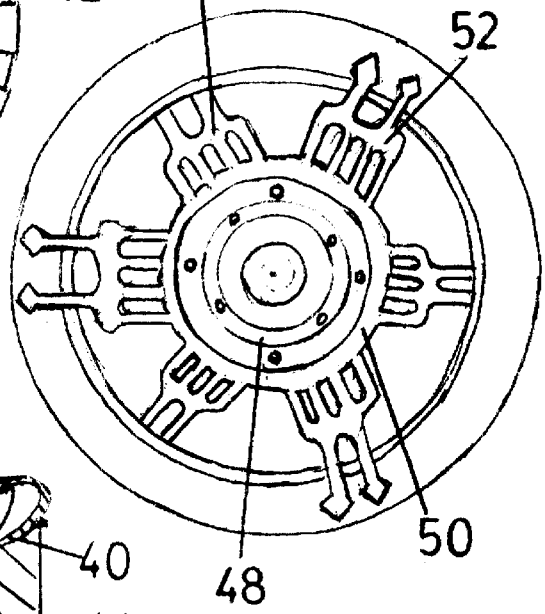
FIG. 8 is a plan view of a further embodiment of a wick assembly.

In FIGS. 7 and 8 details of a yoke 42 are shown, and its manner of engagement with the conical dish 40.

A wick 16 is mounted centrally of the yoke 42, projecting about equally above and below the yoke 42.

The yoke 42 has axially projecting rib portions 48, 50 and radially extending resilient arms 52, 54 extending respectively above and below the adjacent inner edge of the dish 40, and which grip the dish 40 between them, to centre the yoke and to afford controlled heat transfer from the wick 16 to the dish 40.

The presence of one or more wick element portions 46 serve to conduct heat from the upper flame zone, both to the central pool of wax 44 and to the dish 40.

Figure 9:
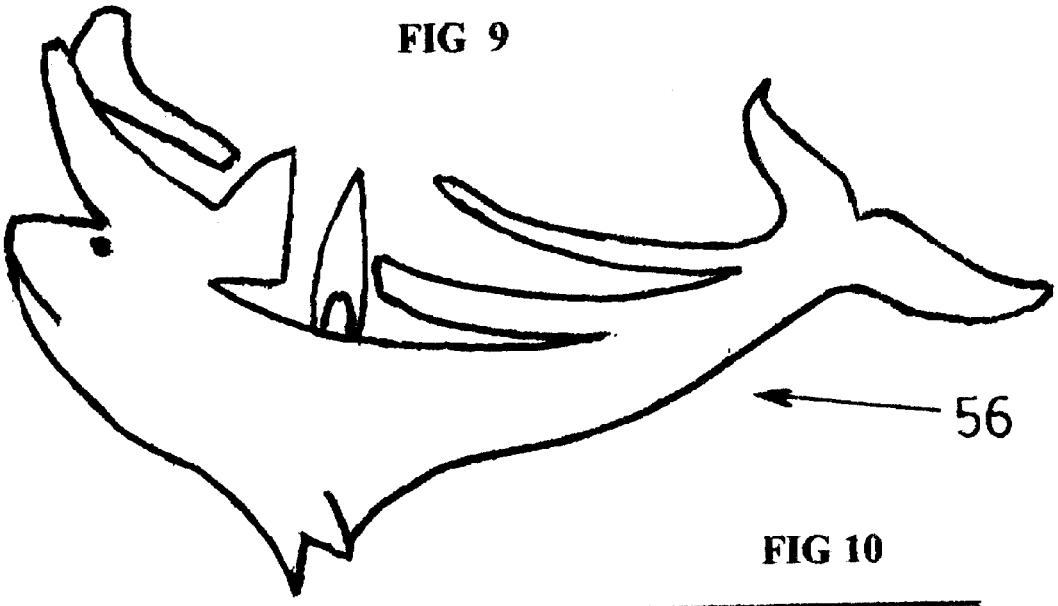
FIG. 9 shows one embodiment of a decorative overlay for use with the subject candles.
Figure 10:
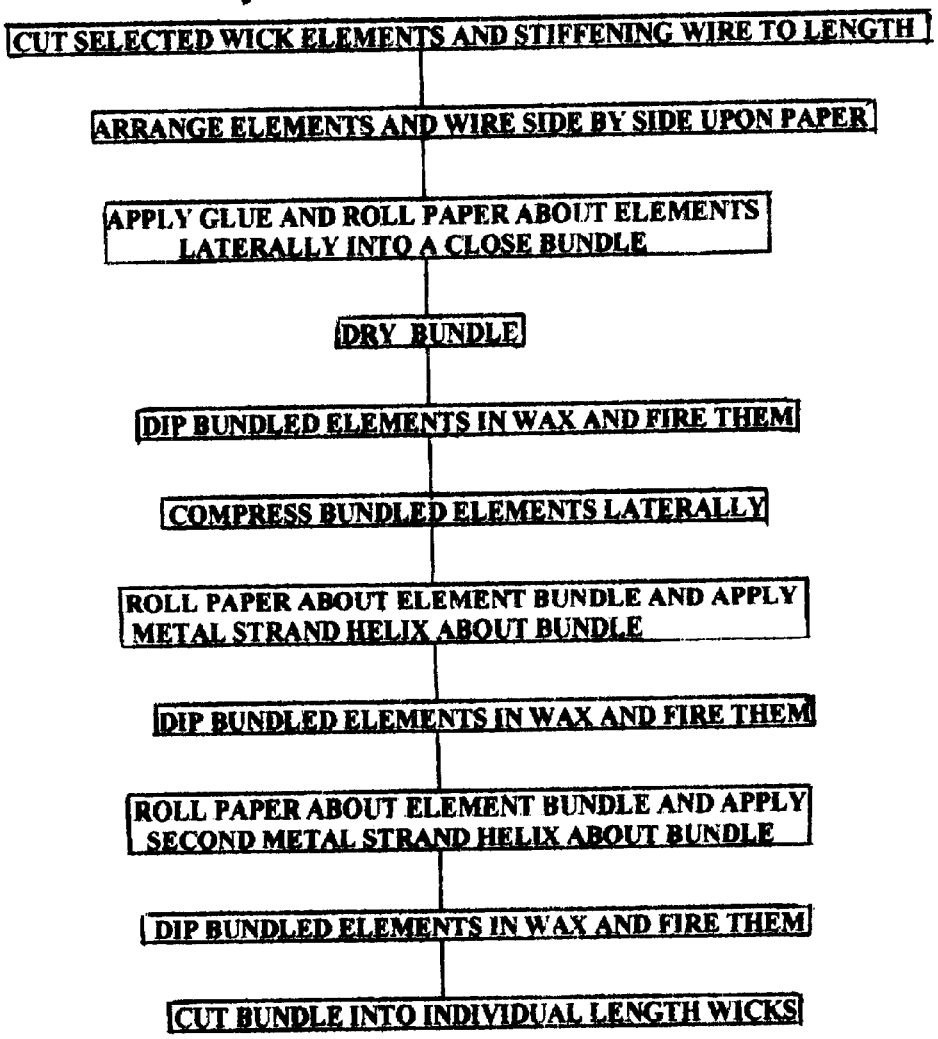
FIG. 10 is a tabular scheme for the manufacture of a wick per se.

The aesthetic appearance of the wick assembly may be enhanced by the addition of a fanciful cut-out, illustrated in FIG. 9 in the form of a fish 56, arranged to partially overly the dish 40 and yoke 42, with provision for the candle flame to burn upwardly there past, in close proximity therewith.

The wick 16 may be manufactured by a process, the steps of which are set forth as follows:

CUT SELECTED WICK ELEMENTS AND STIFFENING WIRE TO LENGTH—the wick elements may consist of a number of lengths selected from nylon, cotton and polyester string and combinations thereof, with thin straight wire (preferably copper), as a stiffener. One embodiment contained six lengths of string having a 50/50 cotton/nylon mix.

Cotton pipe cleaner may also be used, which possesses a built-in wire stiffener.

ARRANGE ELEMENTS AND WIRE SIDE BY SIDE UPON PAPER—paper towel serves well for this purpose. Also, paper from mulberry bark, as used for translucent window paper in Korea will serve well.

APPLY GLUE AND ROLL PAPER ABOUT ELEMENTS LATERALLY INTO A CLOSE BUNDLE

DRY THE BUNDLE

DIP BUNDLED ELEMENTS IN WAX AND FIRE THEM—by setting the wax alight

COMPRESS FIRED ELEMENTS LATERALLY—this may be done by rolling the bundle in a paper, and compressing the roll, as part of the following step.

ROLL PAPER ABOUT ELEMENT BUNDLE AND APPLY METAL STRAND HELIX ABOUT BUNDLE—the metal strand may consist of sheet aluminum such as may be obtained from a soft-drink or beer can, which strip is tight-wound about the bundle, to assist in its compression.

DIP BUNDLED ELEMENTS IN WAX AND FIRE THEM

ROLL PAPER ABOUT ELEMENT BUNDLE AND APPLY SECOND METAL STRAND HELIX ABOUT BUNDLE—a repeated application of wire helix is preferred, in view of the required long life, long burning characteristics of the candle, and to better facilitate heat transfer

DIP BUNDLED ELEMENTS IN WAX AND FIRE THEM

CUT BUNDLE INTO INDIVIDUAL LENGTH WICKS

The individual wicks are secured to a candle yoke by means of several loose wraps of fine copper wire that engage the inner edge of the yoke.

The foregoing description relates to a manual operation, particularly suited to a cottage industry. However, it will be understood that functionally equivalent structures may be readily mass produced, using different materials and process steps.

Figures 11, 12, 13, 14:
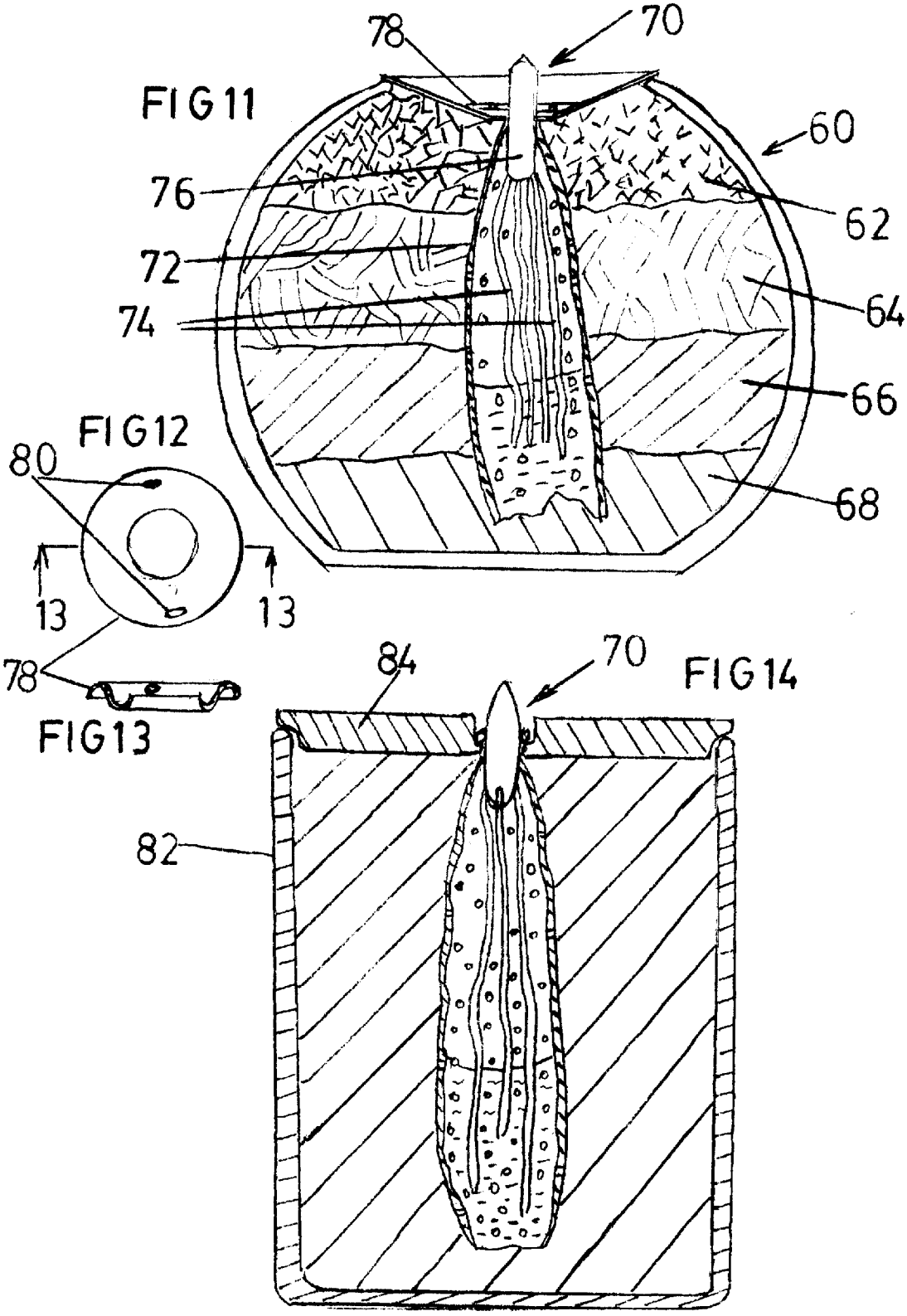
FIG. 11 is an elevational diametrical section view of a bowl-lamp.
FIG. 12 is a plan view of a damper plate for use with the subject candles.
FIG. 13 is a diametrical section at 13—13 of FIG. 12.
FIG. 14 is an elevational diametrical section view of a beaker-lamp.

Turning to the FIG. 11 embodiment, a bowl of glass 60 is shown, having decorative wax layers 62, 64, 66 and 68 which may be cast, shavings or particles. The wick assembly 70 has a protective perforated aluminum skirt 72 and extension wick stings 74, attached to the upper wick assembly 76.

The wax layers 62, 64 etc are hollowed out to accept skirt 72 in closely inserted relation.

Referring also to FIGS. 12 and 13, a coined damper plate 78 is removably located about the protruding upper portion of the wick portion 76. The apertures 80 in the damper plate 78 serve to regulate the rate of combustion of the candle flame, when alight.

Turning to FIG. 14, a ceramic beaker 82 of cylindrical form with lid 84 is shown, having a wick assembly 70 corresponding to that of the bowl-candle of FIG. 11.

In use, such as in a restaurant, a bowl-candle 60 or beaker candle 70 may be left alight at a table all evening, burning on a low flame by virtue of the damper 78 being in place. When the table is occupied, the damper may be removed, to give a brighter light to the table occupants.

Figure 15:
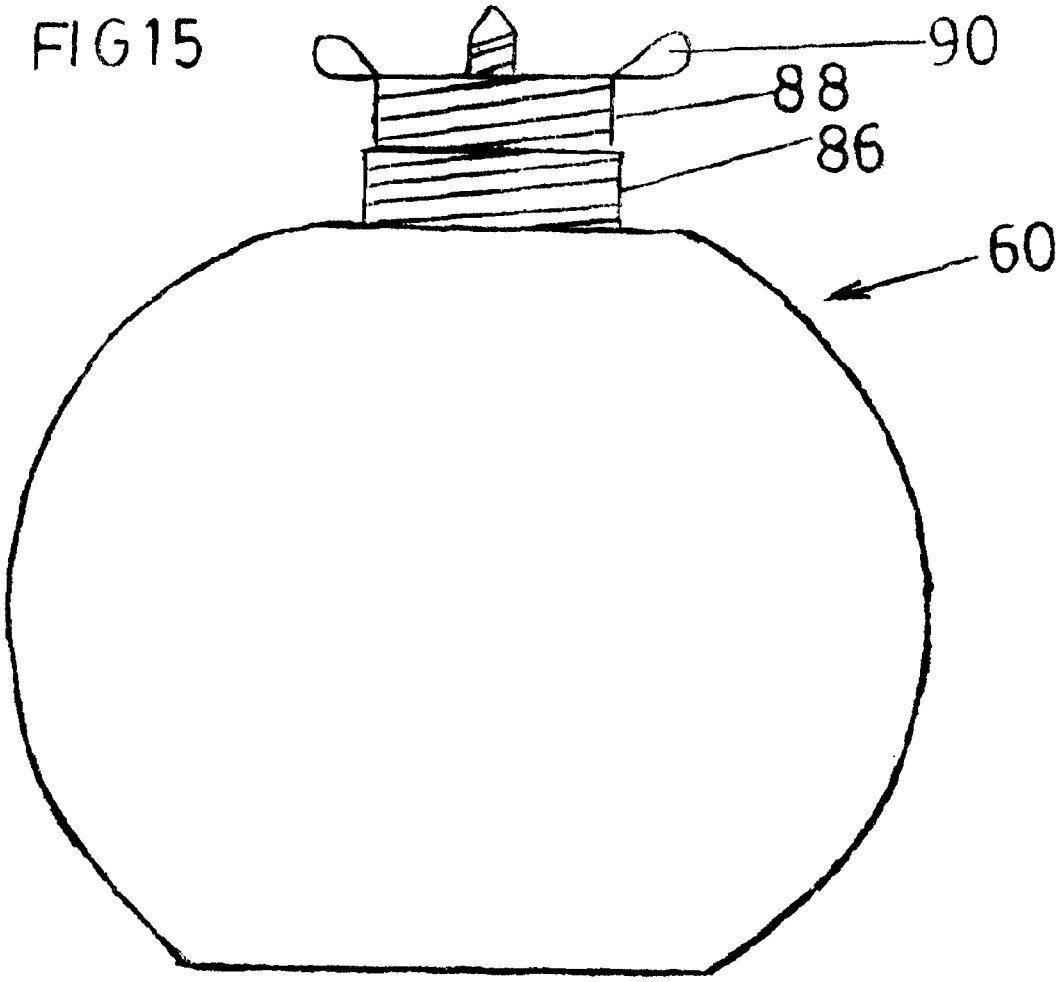
FIG. 15 is an elevational view of a bowl-lamp with an adjustable threaded mounting.

In FIG. 15, a bowl-lamp 60 has a threaded neck portion 86 into which fits a threaded wick carrier 88. The wick carrier 88 has a pair of ornamental projections 90, which facilitate manual rotational adjustment of the wick carrier 88 in a raising or lowering sense, relative to the bowl 60, and thence in relation to the level of a wax pool within the bowl 60.

What is claimed is:

1. A safe-burn candle having a wickless candle body in combination with a superimposed wick assembly, wherein said wick assembly includes a wick portion of predetermined length, and wick mounting means including a perforated platform to receive said wick in partially inserted relation therethrough, said wick portion including an upper, flame holder portion and a lower, heat transfer portion extending downwardly below said platform to convey heat from said candle flame to said wax, in melting relation therewith, said wick portion having at least one metal component extending from said flame holder portion downwardly to said heat transfer portion, in heat transfer relation from said flame holder portion to said heat transfer portion; wherein in use an upper portion of the wick positioned above said platform has a candle flame in combusting relation thereabout, and a lower portion of said wick is at least partially immersed in wicking, heat transfer relation within molten wax located below the platform.

2. The candle as set forth in claim 1, wherein said perforated platform is a substantially laterally symetrical structure of heat conducting, non-flammable material.

3. The candle as set forth in claim 1, wherein said perforated platform is of metal.

4. The candle as set forth in claim 1, wherein said perforated platform is of aluminum.

5. The candle as set forth in claim 3, wherein said perforated metal platform has a central aperture, and yoke means spanning said aperture; said yoke means having said wick portion extending downwardly therethrough in secured relation with said yoke means.

6. The candle as set forth in claim 1, wherein said perforated platform includes a threaded adjustable mounting, in use to enable vertical adjustment of said wick in relation to said molten wax.

7. The candle as set forth in claim 1, wherein said at least one metal component is selected from the group consisting of metal wire and metal strip.

8. The candle as set forth in claim 7, wherein said at least one metal component is a metal strip extending in helix-wound relation about said wick.

9. The candle as set forth in claim 8, wherein said candle has two said wound metal strips.

10. The candle as set forth in claim 1, wherein said wick consists of carbonized fabric having at least one metal component in bound relation therewith, to facilitate the transfer of heat from an upper portion of the wick to a lower portion thereof.

11. The candle as set forth in claim 10, wherein said wick further includes at least one depending trailing wick portion, enabling in use the wicking-up of molten wax from a downwardly receding wax pool.

12. The candle as set forth in claim 11, wherein said at least one depending trailing wick portion consists of a cotton wick of predetermined length sufficient, in use, to maintain wicking contact with said wax pool for a predetermined burning period for said candle.

13. The candle as set forth in claim 11, in combination with a vessel having an upper rim portion, said platform being supported by said vessel, to locate said wick in substantially fixed relation adjacent the top of said vessel.

14. The combination as set forth in claim 13, said vessel being a drinking vessel selected from the group consisting of cups, glasses, steins and tankards.

15. The combination as set forth in claim 14, wherein said vessel has a translucent wall and contains contents visible through the translucent wall.

16. The candle as set forth in claim 1, said wick assembly including a protective skirt in wrapped relation about said at least one supplementary wick portion.

17. The candle as set forth in claim 1, including annular damper means positioned about saidwick upper portion; said damper means having at least one aperture therein, in use to regulate the rate of burning of the candle.

18. A safe-burn candle as set forth in claim 1, wherein said perforated platform consists of a removable lid portion of a cylindrical container.

* * * * *